US006814655B2

(12) United States Patent
Hofmann et al.

(10) Patent No.: US 6,814,655 B2
(45) Date of Patent: Nov. 9, 2004

(54) ATTACHMENT FOR GRINDER

(75) Inventors: Albrecht Hofmann, Steinbronn (DE); Harald Krondorfer, Ludwigsburg (DE); Markus Heckmann, Leinfelden-Echterdingen (DE); Thomas Schomisch, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/362,610

(22) PCT Filed: May 25, 2002

(86) PCT No.: PCT/DE02/01928

§ 371 (c)(1),
(2), (4) Date: Feb. 24, 2003

(87) PCT Pub. No.: WO03/002304

PCT Pub. Date: Jan. 9, 2003

(65) Prior Publication Data

US 2003/0181152 A1 Sep. 25, 2003

(30) Foreign Application Priority Data

Jun. 28, 2001 (DE) ..... 101 31 326

(51) Int. Cl.[7] ..... B24B 41/00
(52) U.S. Cl. ..... 451/342; 451/509
(58) Field of Search ..... 451/342, 359, 451/352, 353, 344, 340, 548, 508, 510, 496, 497, 498, 499, 500, 509

(56) References Cited

U.S. PATENT DOCUMENTS

| | | | | |
|---|---|---|---|---|
| 2,379,997 A | | 7/1945 | Soderberg | |
| 2,747,343 A | | 5/1956 | Gellert | |
| 2,781,618 A | * | 2/1957 | Larson | 451/509 |
| 2,789,402 A | | 4/1957 | Blum | |
| 3,266,200 A | | 8/1966 | Block | |
| 3,491,494 A | * | 1/1970 | Mackay, Jr. | 451/509 |
| 3,623,281 A | * | 11/1971 | Robert | 451/509 |

FOREIGN PATENT DOCUMENTS

| | | |
|---|---|---|
| DE | 15 77 422 A | 4/1970 |
| DE | 1 577 422 | 4/1970 |
| DE | 44 42 978 A1 | 6/1995 |
| DE | 299 13 046 U1 | 4/2000 |

* cited by examiner

*Primary Examiner*—Dung Van Nguyen
(74) *Attorney, Agent, or Firm*—Michael J. Striker

(57) ABSTRACT

An insert tool with grinding blade and a supporting disk, and with a hub, which has at least one opening that permits the hub to be clamped to a driver flange of a grinder, which flange is connected to a drive shaft, wherein the hub is constituted by a component that is separate from the supporting disk, the hub can be operatively connected to a driver device of the grinder by means of at least one detent element, which is supported so that it can move in opposition to a spring element and which engages in detent fashion in an operating position of the hub and fixes the hub in a positively engaging manner.

12 Claims, 4 Drawing Sheets

ATTACHMENT FOR GRINDER

BACKGROUND OF THE INVENTION

The invention is based on an insert tool.

There are known insert tools for grinders, which have a grinding blade and a supporting disk made of rubber as a support for the grinding blade. The supporting disk and the grinding blade are placed with their hubs, which each have an essentially round opening in the middle, onto a drive shaft whose free end has a thread formed onto it. A nut that can be screwed onto the thread can clamp the grinding blade against the supporting disk and clamp the supporting disk against a flange connected to the drive shaft. When mounted, this produces a positive engagement in the axial direction and a frictional engagement in the circumference direction between the grinding blade, the supporting disk, and the flange.

SUMMARY OF THE INVENTION

The invention is based on an insert tool with a grinding blade and a supporting disk as well as a hub, which has at least one opening that can be used to clamp the hub to a driver flange of a grinder, which flange is connected to a drive shaft.

The invention proposes that the hub be comprised of a component that is separate from the supporting disk. This permits a particularly inexpensive and easily stackable insert tool to be produced, whose hub can easily be designed for a conventional driver device of a grinder with a nut and/or can be designed for a quick clamping system.

In an advantageous embodiment of the invention, the insert tool can be operatively connected to a driver device of the grinder by means of at least one detent element, which is supported so that it can move in opposition to a spring element and which engages in detent fashion in an operating position of the insert tool and fixes the insert tool in a positively engaging manner. The positive engagement permits a high degree of safety to be achieved and permits a simple, inexpensive, tool-free quick clamping system to be produced. The insert tool can be reliably prevented from unintentionally coming loose, even in braked drive shafts in which high braking moments can occur.

The movably supported detent element can permit a large deflection of the detent element during installation of the insert tool, which on the one hand, allows for a large overlap between two corresponding detent elements and a particularly reliable positive engagement and on the other hand, can produce an easily audible detent engagement noise, which advantageously informs an operator that a desired detent engagement has been achieved.

The detent element can fix the insert tool in a positively engaging manner directly or indirectly by means of an additional component, for example by means of a detent lever, plunger, or the like, which is coupled to the detent element and is supported in a rotating and/or axially movable fashion. Through positive engagement, the detent element can directly and/or indirectly fix the insert tool in various directions, such as in the radial direction, the axial direction, and/or particularly advantageously, in the circumference direction. It is also possible that the positively engaging fixing of the insert tool by means of the detent element in a first direction, for example in the radial direction, causes the insert tool to be fixed in a positively engaging manner in a second direction, for example in the circumference direction, by a component that is separate from the detent element.

If the hub has at least one first opening let into it for producing a positively engaging attachment to the driver device in at least one circumference direction and has at least one second opening let into it, which is separate from the first opening and is for producing a positively engaging attachment in the axial direction, then simple and inexpensive hubs can be produced, which can be advantageously embodied as essentially flat and without hooks. This can prevent the hubs from getting caught on one another during manufacture and storage, and permits a favorable handling of the insert tool by means of its hub. In addition, the components for fastening the hub can be designed advantageously for their function, i.e. either for fixing in the circumference direction or for fixing in the axial direction.

The hubs can advantageously be simply designed, with a closed centering bore, and a low-vibration operation of the insert tool can be achieved. In addition, a suitable choice of the diameter of the centering bore can permit the insert tools according to the invention to be fastened to conventional grinders using previously known fastening devices, in particular using fastening devices in which a clamping nut and a clamping flange can be used to fix the insert tool against a support surface on the drive shaft, with positive engagement in the axial direction and with frictional engagement in the circumference direction.

Another embodiment of the invention proposes that the hub have at least one oblong hole let into it, which has a wide region and at least one narrow region. The hub can be easily clamped in the axial direction by means of the oblong hole. In this connection, the hub can be used as a spring element, for example, in that the hub is elastically deformed while the component is being slid in the oblong hole. In addition, the hub can be used to deflect a component in the axial direction in opposition to a spring element. This permits savings with regard to additional components, installation work, and costs.

The invention also proposes that the hub have a contour, in particular an outer contour, that deviates from a rotationally symmetrical form, which can be attached in a positively engaging manner in the circumference direction to a corresponding contour, in particular an inner contour, of the supporting disk. A torque can advantageously be transmitted from the hub to the supporting disk by means of a positive engagement. Additional fastening elements, for example for producing a frictional engagement, can be avoided or at least assisted in their function, and costs can be reduced. The hub can be fastened directly to the driver flange, which permits a particularly exact positioning of the hub, the grinding blade, and the supporting disk in relation to one another. In addition, short detent elements can reach through the hub and secure it. The hub can have various contours deemed appropriate by one skilled in the art in order to transmit the torque by means of positive engagement, for example an oval or polygonal contour, etc., which can be formed onto various regions of the hub.

Another embodiment of the invention proposes that the contour, which deviates from a rotationally symmetrical form, be formed onto a shaped part of the hub that points in the axial direction, which permits a large transmitting surface to be produced between the hub and the supporting disk and therefore achieves an advantageously low surface pressure when transmitting a torque by means of the transmitting surface.

If the shaped part has inclined side walls, then the hub can be stacked in a particularly advantageous manner and the hub can be centered in the supporting disk.

The hub can be comprised of various materials deemed appropriate by one skilled in the art, for example a high-impact plastic, etc. However, it is advantageous if the hub is comprised of a deep-drawn sheet metal part, which makes it particularly inexpensive and easy to produce.

In the installed position, if a support surface of the hub and a support surface of the supporting disk are disposed in a common plane in the axial direction toward the grinder, then a corresponding support surface of a flange can be used jointly for both the supporting disk and the hub, and a common reference plane can be achieved. This saves on additional components and advantageously permits the achievement of a precise association of the supporting disk and the hub in relation to each other.

Another embodiment of the invention proposes that the hub be comprised of a component that is separate from the grinding blade, which permits an inexpensive manufacture, a space-saving storage, and a particularly simple reuse of the sheet metal hub.

If the hub, in the region in which it abuts the grinding blade, has a contour, which deviates from a rotationally symmetrical form and can be attached to a corresponding contour of the grinding blade in a positively engaging manner in the circumference direction, then the contours can be used to advantageously transmit a torque in a positively engaging manner. Additional fastening elements for transmitting a torque from the hub to the grinding blade can be assisted in their function or possibly be completely replaced. Basically, however, the hub can be attached to the grinding blade by means of any frictionally engaging, positively engaging, and/or materially adhesive connection deemed appropriate by one skilled in the art, for example a glued connection, riveted connection, clamped connection, etc.

If the hub has claws that can dig into the grinding blade, then the hub can be attached to the grinding blade in a simple, reliable, tool-free manner. A small axial force between the hub and the grinding blade permits powerful holding forces to be produced in the circumference direction. The axial force can advantageously be produced in the process of mounting the insert tool onto the grinder.

The claws can be comprised of additional components fastened to the hub. However, it is advantageous for the claws to be formed onto the hub, for example by means of a punching process. The production of the claws, therefore, can be advantageously integrated into the manufacturing process of the hub and additional components are not required.

DESCRIPTION OF THE PREFERRED EMBODIMENTS

Figure 1:
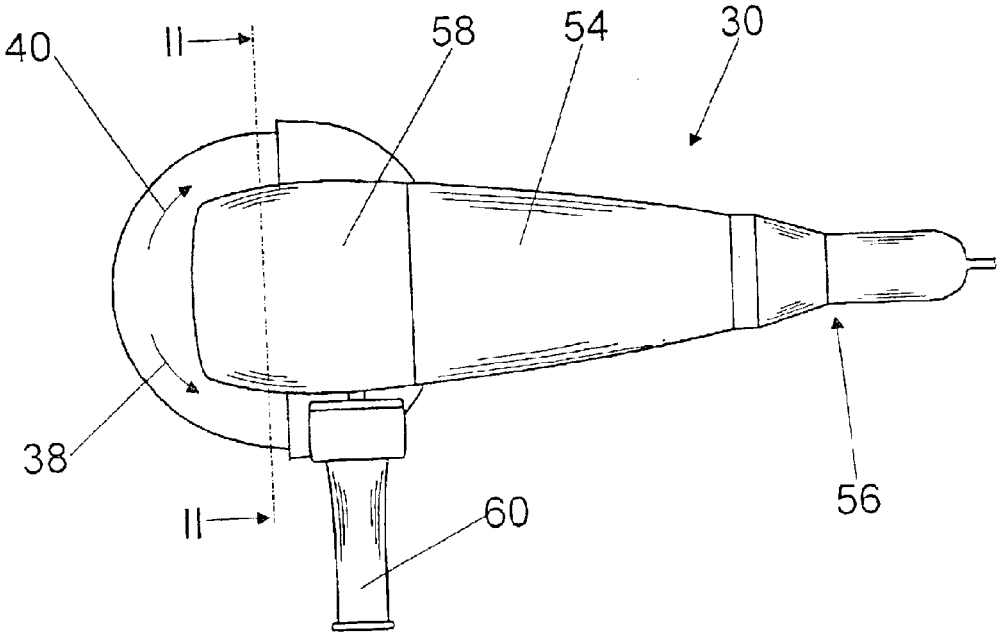
FIG. 1 shows a top view of an angle grinder.

FIG. 1 shows a top view of an angle grinder 30 with an electric motor, not shown in detail, contained in a housing 54. The angle grinder 30 can be guided by means of a first handle 56, which is integrated into the housing 54 on the side oriented away from an insert tool and extends in the longitudinal direction, and by means of a second handle 60, which is attached to the transmission housing 58 in the vicinity of the insert tool and extends lateral to the longitudinal direction.

Figure 2:
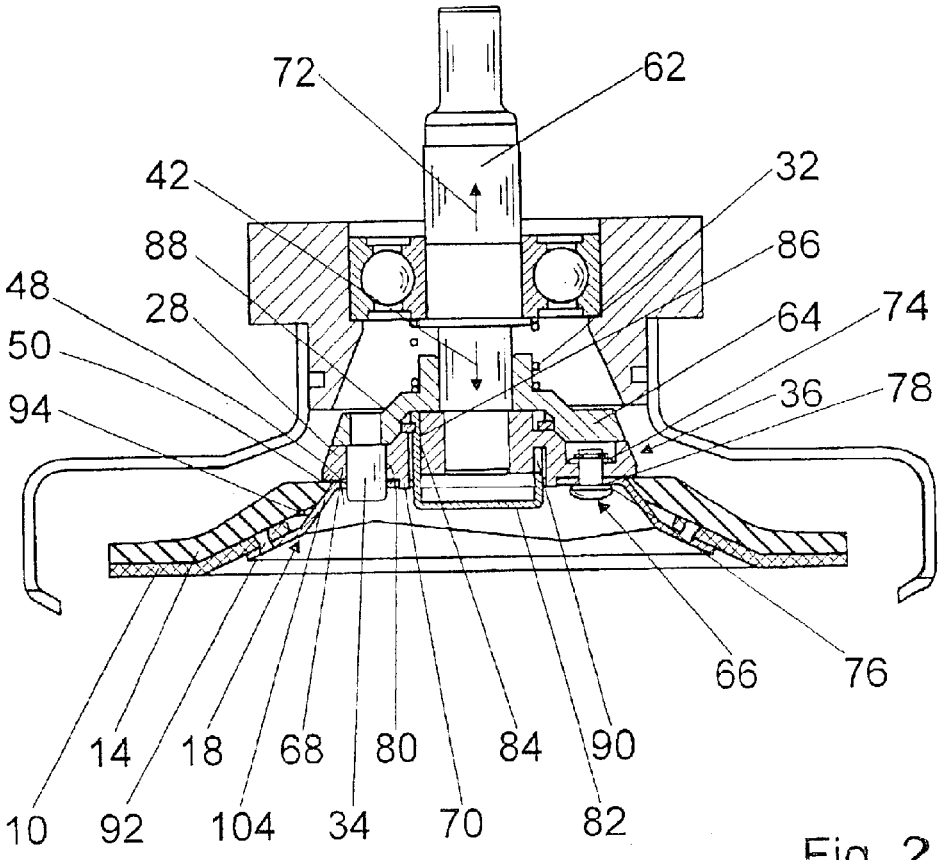
FIG. 2 shows a schematic cross section along the line II—II in FIG. 1.

By means of a transmission that is not shown in detail, the electric motor can drive a drive shaft 62, whose end oriented toward the insert tool is provided with a driver device 36 (FIG. 2). On a side oriented toward the insert tool, the driver device 36 has a driver flange 28, which is press-fitted onto the drive shaft 62, and on a side oriented away from the insert tool, the driver device 36 has a driver disk 64, which is supported so that it can move axially on the drive shaft 62 in opposition to a helical spring 32 disposed in the middle. The driver flange 28 that constitutes a support surface 68 for the insert tool has a collar 70 formed onto it, which in the installed position, radially centers the insert tool by means of its centering bore 26. The driver flange 28 can advantageously absorb radial forces.

The driver flange 28 is provided with three pins 66, which are disposed at uniform successive intervals in the circumference direction 38, 40 and extend beyond the driver flange 28 and beyond the support surface 68, in the axial direction 42 toward the insert tool, and these pins 66 are supported so that they can be slid in the axial direction 42, each in opposition to a respective disk spring 74 in order to axially fix the insert tool.

On their ends oriented toward the insert tool, the pins 66 each have a head, which has a larger diameter than the rest of the pin 66, and on an end oriented toward the driver flange 28, the pins 66 each have a conical contact surface 76 that tapers in the axial direction 72 and a contact surface 78 that extends parallel to the support surface 68.

Three axial through bores 80 are let into the driver flange 28 one after the other in the circumference direction 38, 40; each through bore 80 is disposed in the circumference direction 38, 40 between two pins 66.

Three bolts 34 one after the other in the circumference direction 38, 40 are press-fitted into the driver disk 64, which is supported so that it can slide axially on the drive shaft 62; these bolts extend toward the insert tool, beyond the driver disk 64 in the axial direction 42. The helical spring 32 presses the driver disk 64 against the driver flange 28 in the direction 42 toward the insert tool. The bolts 34 protrude through the through bores 80 and extend beyond the driver flange 28 in the axial direction 42.

The driver device 36 also has a cup-shaped release button 82 situated in the middle of the side oriented toward the insert tool. The release button 82 has three segments 84 uniformly spaced in the circumference direction 38, 40, which extend in the axial direction 72 toward the axially movable driver disk 64 and which reach through corresponding recesses 86 in the driver flange 28 and are affixed to the driver disk 64 in the axial direction 42, 72 by means of a snap ring 88. The release button 82 is guided so that it can slide in the axial direction 42, 72 in an annular recess 90 in the driver flange 28.

Figure 3:
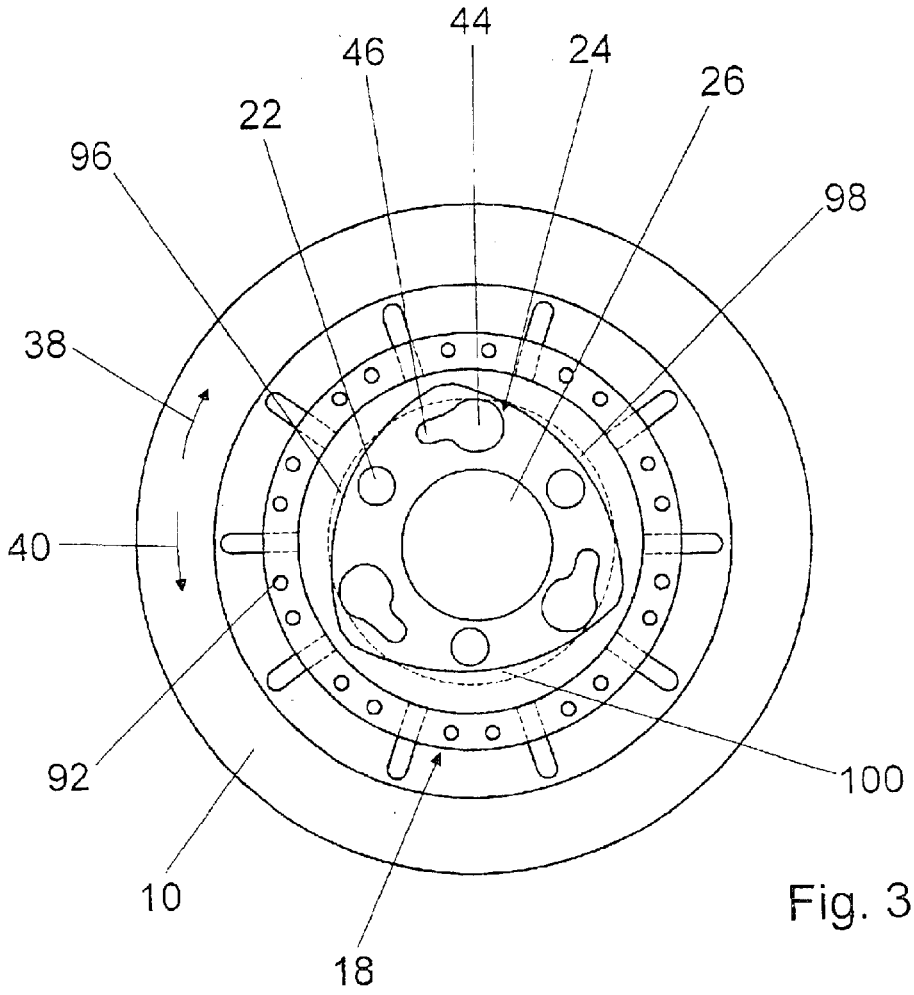
FIG. 3 shows a bottom view of an insert tool from FIGS. 1 and 2.

The insert tool has a grinding blade 10, a supporting disk 14 made of rubber, and a deep-drawn sheet metal hub 18, which is comprised of a component that is separate from the supporting disk 14. On its outer circumference, the sheet metal hub 18 is pressed against the grinding blade 10 and fastened to it by means of rivets 92 (FIGS. 2 and 3).

The sheet metal hub 18 has a shaped part 94, which points in the axial direction toward the angle grinder 30 and has inclined side walls 104 (FIG. 2). The shaped part 94 has an outer contour that deviates from a rotationally symmetrical form, in the shape of a triangle with rounded sides (FIG. 3). The outer contour of the shaped part 94 corresponds to an inner contour of the annular supporting disk 14 so that the outer contour of the sheet metal hub 18 can be inserted into the supporting disk 14 in a positively engaging manner in the circumference direction 38, 40 and, during operation, a torque can be transmitted from the sheet metal hub 14 to the supporting disk 14 in a positively engaging fashion.

When the insert tool is being mounted, the supporting disk 14 is placed against the support surface 68 of the driver flange 28; the supporting disk 14 comes to rest in three edge regions 96, 98, 100 of the support surface 68 of the driver flange 28 that are distributed uniformly over the circumference. The round support surface 68 of the driver flange 28 overlaps the inner contour of the supporting disk 14 on the side oriented toward the driver device 36; in the middle region of the sides, this inner contour is designed to correspond to the outer contour of the shaped part 94 in the form of a triangle with rounded sides.

Then the shaped part 94 of the sheet metal hub 18 is inserted into the supporting disk 14 and is centered. The sheet metal hub 18 and the supporting disk 14 are then attached to the driver device 36.

The sheet metal hub 18 has three bores 22, which are disposed one after the other and distributed uniformly in the circumference direction 38, 40 and whose diameter is slightly greater than the diameter of the bolts 34. In addition, the sheet metal hub 18 has three oblong holes 24, which are distributed uniformly in the circumference direction 38, 40 and extend in the circumference direction 38, 40, each of which has a narrow region 46 and a wide region 44 produced by means of a bore, whose diameter is slightly greater than the diameter of the heads of the pins 66.

The centering bore 26 is also let into the sheet metal hub 18 and its diameter is advantageously selected so that the insert tool can also be clamped to a conventional angle grinder using a conventional clamping system with a clamping flange and a spindle nut. A so-called backward compatibility is assured.

When the insert tool is being mounted, the sheet metal hub 18 is slid with its centering bore 26 onto the release button 82 and is radially centered. Then, the grinding blade 10, the sheet metal hub 18, and, due to the positive engagement with the supporting disk 14, the latter as well, i.e. the entire insert tool, are rotated until the pins 66 engage in the wide regions 44 provided for this purpose in the oblong holes 24 of the sheet metal hub 18. Pressing the sheet metal hub 18 against the support surface 68 of the driver flange 28 causes the bolts 34 to slide into the through bores 80 and causes the driver disk 64 to be slid axially in the direction 72 oriented away from the insert tool, counter to a spring force of the helical spring 32 on the drive shaft 62.

Rotating the sheet metal hub 18 further in the direction opposite from the drive direction 40 causes the pins 62 to be slid into the arc-shaped narrow regions 46 of the oblong holes 24. As a result, the pins 66 are slid by means of the conical contact surfaces 76 axially in the direction 42, counter to the force of the disk springs 74 until the contact surfaces 78 of the pins 66 overlap the edges of the oblong holes 24 in the arc-shaped narrow regions 46. By means of the contact surfaces 78 of the pins 66, the disk springs 74 press the insert tool or the sheet metal hub 18 with its support surface 48 and, via the sheet metal hub 18 that overlaps the supporting disk 14, press the supporting disk 14 with its support surface 50 against the support surface 68 of the driver flange 28. The support surface 48 of the sheet metal hub 18 and the support surface 50 of the supporting disk 14 come to rest in a common plane in the axial direction 72 toward the angle grinder 30, a plane that is defined by the support surface 68 of the driver flange 28.

Instead of being loaded with a number of disk springs 74, the pins 66 can also be loaded by a shared spring element, for example by a disk spring, not shown in detail, that extends over the entire circumference.

In one end position, or in an achieved operating position of the insert tool, the bores 22 in the sheet metal hub 18 come to rest over the through bores 80 of the driver flange 28. The spring force of the helical spring 32 causes the bolts 34 to slide axially in the direction 42 of the insert tool, engage in detent fashion in the bores 22 of the sheet metal hub 18, and fix it in a positively engaging manner in both circumference directions 38, 40. The detent engagement produces an audible detent engagement noise, which advantageously notifies an operator that it is ready for operation.

A driving torque of the electric motor of the angle grinder 30 can be transmitted from the drive shaft 62 to the driver flange 28 in a frictionally engaging or positively engaging manner, and from the driver flange 28 to the sheet metal hub 18 in a positively engaging manner via the bolts 34, and from the sheet metal hub 18 to the supporting disk 14 in a positively engaging manner via the contours that deviate from a rotationally symmetrical form, and to the grinding blade 10 via the rivets 92.

A braking moment, which occurs during and after the switching off of the electric motor and is directed counter to the driving torque, can be transmitted in a positively engaging manner from the driver flange 28 to the insert tool via the bolts 34. The insert tool is reliably prevented from unintentionally coming loose. The three bolts 34 distributed uniformly in the circumference direction 38, 40 produce an advantageous uniform distribution of forces and masses.

To detach the insert tool from the angle grinder 30, the release button 82 is pressed. The release button 82 slides the driver disk 64 with the bolts 34 in opposition to the helical spring 32, in the axial direction 72 oriented away from the insert tool, which causes the bolts 34 to move in the axial direction 72, out of their detent position, and out of the bores 22 of the sheet metal hub 18. Then the insert tool is rotated in the drive direction 40 until the pins 66 come to rest in the wide regions 44 of the oblong holes 24 and the insert tool can be removed from the driver flange 28 in the axial direction 42. After the release button 82 is released, the helical spring 32 slides the driver disk 64, the bolts 34, and the release button 82 back into their starting positions.

Figure 4:
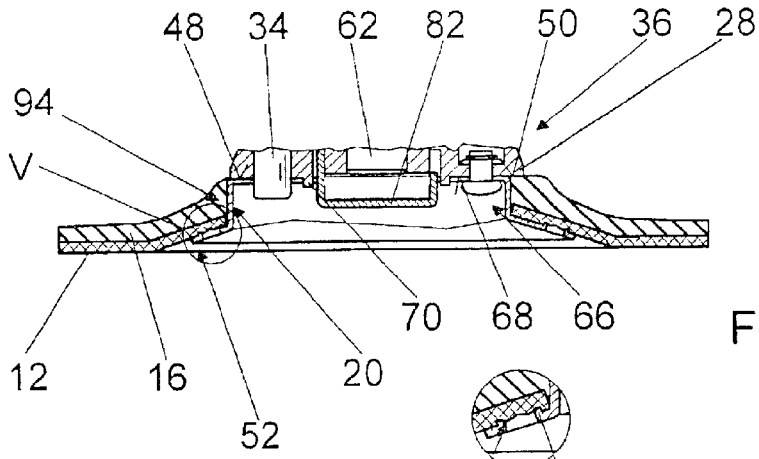
FIG. 4 shows an insert tool alternative to the insert tool from FIG. 2.
Figure 5:
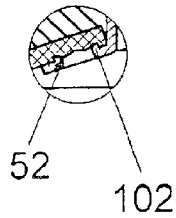
FIG. 5 shows an enlarged detail V from FIG. 4.
Figure 6:
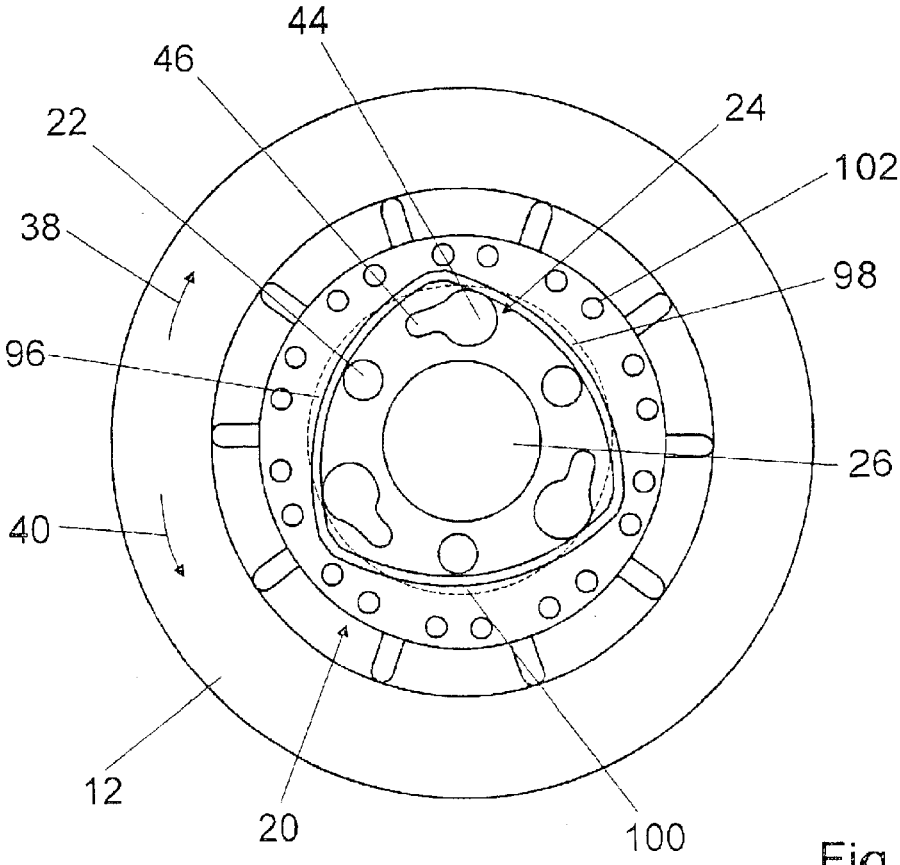
FIG. 6 shows a bottom view of the insert tool from FIG. 4.

FIGS. 4, 5, and 6 show an alternative insert tool. In principle, components that remain essentially the same are provided with the same reference numerals. In addition, descriptions of those features and functions that remain the same can be taken from the description relating to the exemplary embodiment shown in FIGS. 1 to 4. The description below will be essentially limited to the differences from the exemplary embodiment in FIGS. 1 to 4.

The insert tool has a sheet metal hub 20, a grinding blade 12, and a supporting disk 16 made of rubber, the sheet metal hub 20 being a component that is separate from the supporting disk 16 and the grinding blade 12.

The sheet metal hub 20 has a shaped part 94, which points in the axial direction toward the angle grinder 30. The shaped part 94 comprises an abutting piece for the grinding blade 12 and supporting disk 16 and has an outer contour, which deviates from a rotationally symmetrical form, in the form of a triangle with rounded sides (FIG. 6). The outer contour of the shaped part 94 corresponds to an inner contour of the annular supporting disk 16 and an inner contour of the grinding blade 12 so that the sheet metal hub 20 can be slid with its outer contour into the grinding blade 12 and the supporting disk 16 in a positively engaging manner in the circumference direction 38, 40 and during operation, a torque can be transmitted from the sheet metal hub 20 to the grinding blade 12 and the supporting disk 16 in a positively engaging manner.

An additional torque transmission between the sheet metal hub 20 and the grinding blade 12 occurs by means of claws 52 formed onto the sheet metal hub 20, which can dig into the grinding blade 12 when the insert tool is being attached to the angle grinder 30. The claws 52 are comprised of opening edges 102, which are bent upward on the side oriented toward the grinding blade 12 (FIG. 5).

| Reference Numerals | |
|---|---|
| 10 | grinding blade |
| 12 | grinding blade |
| 14 | supporting disk |
| 16 | supporting disk |
| 18 | hub |
| 20 | hub |
| 22 | opening |
| 24 | opening |
| 26 | opening |
| 28 | driver flange |
| 30 | grinder |
| 32 | spring element |
| 34 | detent element |
| 36 | driver device |
| 38 | circumference direction |
| 40 | circumference direction |
| 42 | direction |
| 44 | region |
| 46 | region |
| 48 | support surface |
| 50 | support surface |
| 52 | claws |
| 54 | housing |
| 56 | handle |
| 58 | transmission housing |
| 60 | handle |
| 62 | drive shaft |
| 64 | driver disk |
| 66 | pin |
| 68 | support surface |
| 70 | collar |
| 72 | direction |
| 74 | disk spring |
| 76 | contact surface |
| 78 | contact surface |
| 80 | through bore |
| 82 | release button |
| 84 | segment |
| 86 | recess |
| 88 | snap ring |
| 90 | recess |
| 92 | rivets |
| 94 | shaped part |
| 96 | edge region |
| 98 | edge region |
| 100 | edge region |
| 102 | opening edge |
| 104 | side wall |

What is claimed is:

1. An insert tool with grinding blade (10, 12) and a supporting disk (14, 18), and with a hub (18, 20), which has at least one opening (22, 24, 26) that permits the hub (18, 20) to be clamped to a driver flange (28) of a grinder (30), which flange is connected to drive shaft (62), characterized in that the hub (18, 20) is constituted by a component that is separate from the supporting disk (14, 16), the hub (18, 20) can be operatively connected to a driver device (36) of the grinder (30) by means of at least one detent element (34), which is supported so that it can move in opposition to a spring element (32) and which engages in detent fashion in an operating position of the hub (18,20) and fixes the hub (18, 20) in a positively engaging manner.

2. The insert tool according to claim 1, characterized in that the hub (18, 20) has at least one first opening (22) let into it for producing a positively engaging attachment to the driver device (36) in at least one circumference direction (38, 40) and has at least one second opening (24) let into it, which is separate from the first opening (22) and is for producing a positively engaging attachment in the axial direction (42).

3. The insert tool according to claim 2, characterized in that the hub (18, 20) has at least one oblong hole (24) let into it, which has a wide region (44) and at least one narrow region (46).

4. The insert tool according to claim 1, characterized in that the hub (18, 20) has a contour that deviates from a rotationally symmetrical form, which can be attached to a corresponding contour of the supporting disk (14, 18) in a positively engaging manner in the circumference direction (38, 40).

5. The insert tool according to claim 4, characterized in that the contour, which deviates from a rotationally symmetrical form, is formed onto a shaped part (94) of the hub (18, 20) that points in the axial direction.

6. The insert tool claim 5, characterized in that the shaped part (94) has inclined side walls (104).

7. The insert tool according to claim 1, characterized in that the hub (20) is comprised of a component that is separate from the grinding blade (12).

8. An insert tool with grinding blade (10, 12) and a supporting disk (14, 16), and with a hub (18, 20), which has at least one opening (22, 24, 26) that permits the hub (18, 20) to be clamped to a driver flange (28) of a grinder (30), which flange is connected to a drive shaft (62), characterized in that the hub (18, 20) is constituted by a component that is separate from the supporting disk (14, 16), and the hub (18, 20) is a deep-drawn sheet metal part.

9. An insert tool An insert tool with grinding blade (10, 12) and a supporting disk (14, 16), and with a hub (18, 20), which has at least one opening (22, 24, 26) that permits the hub (18, 20) to be clamped to a driver flange (28) of a grinder (30), which flange is connected to a drive shaft (62), characterized in that the hub (18, 20) is constituted by a component that is separate from the supporting disk (14, 16), and in the vicinity in which it abuts the grinding blade (12) the hub (20) has a contour, which deviates from a rotationally symmetrical form and can be attached to a corresponding contour of the grinding blade (12) in a positively engaging manner in the circumference direction (38, 40).

10. An insert tool with grinding blade (10, 12) and a supporting disk (14, 16), and with a hub (18, 20), which has at least one opening (22, 24, 26) that permits the hub (18, 20) to be clamped to a driver flange (28) of a grinder (30), which flange is connected to a drive shaft (62), characterized in that the hub (18, 20) is constituted by a component that is separate from the supporting disk (14, 16), and (20) has claws (52) that can dig into the grinding blade (12).

11. An insert tool with grinding blade (10, 12) and a supporting disk (14, 16), and with a hub (18, 20), which has at least one opening (22, 24, 26) that permits the hub (18, 20)

to be clamped to a driver flange (28) of a grinder (30), which flange is connected to a drive shaft (62), characterized in that the hub (18, 20) is constituted by a component that is separate from the supporting disk (14, 16), and in the installed position, a support surface (48) of the hub (18,20) oriented toward the grinder (30) and a support surface (50) of the supporting disk (14, 16) oriented toward the grinder (30) are disposed in a common plane in the axial direction (72) toward the grinder (30).

12. The insert tool according to claim 11, characterized in that said common plane is defined by a support surface (68) of the driver flange (28).

* * * * *